US010260233B2

(12) United States Patent
Meilleur et al.

(10) Patent No.: US 10,260,233 B2
(45) Date of Patent: Apr. 16, 2019

(54) PREFABRICATED MODULE FOR CASTING A CONCRETE WALL

(71) Applicant: Polycrete International Inc., Montréal (CA)

(72) Inventors: Serge Meilleur, Varennes (CA); André Grenon, Ste-Julie (CA)

(73) Assignee: POLYCRETE INTERNATIONAL INC., Montréal (CA)

( * ) Notice: Subject to any disclaimer, the term of this patent is extended or adjusted under 35 U.S.C. 154(b) by 0 days.

(21) Appl. No.: 15/393,795

(22) Filed: Dec. 29, 2016

(65) Prior Publication Data

US 2017/0107715 A1 Apr. 20, 2017

Related U.S. Application Data

(63) Continuation of application No. PCT/CA2015/000417, filed on Jun. 25, 2015.

(60) Provisional application No. 62/020,985, filed on Jul. 3, 2014.

(51) Int. Cl.

| | |
|---|---|
| ***E04B 2/86*** | (2006.01) |
| ***E04G 5/14*** | (2006.01) |
| ***E04G 17/075*** | (2006.01) |
| ***E04G 11/06*** | (2006.01) |
| ***E04G 17/00*** | (2006.01) |

(52) U.S. Cl.

CPC ..... *E04B 2/8635* (2013.01); *E04G 5/14* (2013.01); *E04G 11/06* (2013.01); *E04G 17/002* (2013.01); *E04G 17/0754* (2013.01); *E04G 17/0758* (2013.01); *E04B 2002/867* (2013.01); *E04B 2002/8688* (2013.01); *E04B 2002/8694* (2013.01)

(58) Field of Classification Search

CPC ... E04G 17/002; E04G 11/06; E04G 17/0758; E04G 5/14; E04B 2/8635; E04B 2002/867; E04B 2002/8694; E04B 2002/8688

USPC ..... 52/426, 428

See application file for complete search history.

(56) References Cited

U.S. PATENT DOCUMENTS 2,335,303 A * 11/1943 Olsen ..... E04B 9/22 52/489.2
3,827,205 A * 8/1974 Barbera ..... E04B 2/8635 52/381
4,194,337 A * 3/1980 Fischer ..... E04B 1/4185 52/713

(Continued)

FOREIGN PATENT DOCUMENTS

EP 2 267 235 B1 9/2013

OTHER PUBLICATIONS

International Search Report issued for corresponding International Patent Application No. PCT/CA2015/000417 dated Sep. 10, 2015.

(Continued)

*Primary Examiner* — Adriana Figueroa
(74) *Attorney, Agent, or Firm* — Myers Wolin, LLC

(57) ABSTRACT

A concrete wall formwork module is provided in which the lateral and longitudinal opposite side edges of the modules are provided with complementary shapes that lock in place two adjacent modules when they are both deployed. The opposite side edges of adjacent modules interlock in one direction and are configured for adjoining according to a shiplap arrangement in the other direction.

23 Claims, 9 Drawing Sheets

(56) References Cited

U.S. PATENT DOCUMENTS 4,742,659 A * 5/1988 Meilleur ..... E04B 2/54 52/309.12
4,888,931 A * 12/1989 Meilleur ..... E04B 2/8652 52/426
4,901,494 A * 2/1990 Miller ..... E04B 2/8647 249/216
4,967,528 A * 11/1990 Doran ..... E04B 2/8647 52/309.12
6,070,380 A * 6/2000 Meilleur ..... E04B 2/8617 52/309.11
6,178,711 B1 * 1/2001 Laird ..... E04B 2/8635 52/357
6,240,692 B1 * 6/2001 Yost ..... E04B 2/8635 52/426
7,082,731 B2 * 8/2006 Patz ..... E04B 2/8635 52/309.11
7,347,029 B2 * 3/2008 Wostal ..... E04B 2/8617 52/426
7,565,777 B2 * 7/2009 Sweeney ..... E04B 2/8617 52/309.11
8,266,859 B1 * 9/2012 Harrington ..... E04B 2/8652 52/426
8,276,340 B2 * 10/2012 Meilleur ..... E04B 2/8635 52/419
9,091,089 B2 * 7/2015 Pfeiffer ..... E04G 17/12
9,175,486 B2 * 11/2015 Pfeiffer ..... B28B 7/02
2002/0178676 A1 * 12/2002 Yost ..... E04B 2/8635 52/426
2014/0259990 A1 9/2014 Pfeiffer
2014/0260055 A1 9/2014 Pfeiffer

OTHER PUBLICATIONS

Written Opinion of the International Searching Authority issued for corresponding International Patent Application No. PCT/CA2015/000417 dated Sep. 10, 2015.

* cited by examiner

PREFABRICATED MODULE FOR CASTING A CONCRETE WALL

CROSS-REFERENCE TO RELATED APPLICATIONS

This application is a continuation of International Application PCT/CA2015/000417, filed Jun. 25, 2015, which claims the benefit of U.S. Provisional Application No. 62/020,985, filed on Jul. 3, 2014, the contents of each of which are incorporated by reference herein.

BACKGROUND

The present invention relates to concrete forms. More specifically, the present invention is concerned with prefabricated concrete wall formwork modules that can be assembled like bricks to form a mold into which concrete is poured. Once assembled and filled with concrete, the modules are left in place thereby providing a concrete wall with panels on both of its sides.

A formwork for casting a concrete wall is traditionally assembled on the premises using two wood or metal panels maintained in spaced parallel relationship by tie-wires and other appropriate connection means at their ends. Such formwork is expensive since its mounting and dismounting are time consuming.

U.S. Pat. No. 4,888,931 issued to Meilleur on Dec. 26, 1989 and entitled "Insulating Formwork for Casting a Concrete Wall" discloses an insulating formwork for casting a concrete wall, which is made of foam panels connectable to each other in parallel relationship by means of tie-rods. Once assembled, the panels define a concrete formwork into which concrete can be poured.

Even though the assembly of this formwork is simplified by the configuration of the panels, the formwork must still be completely assembled on the premises, thereby requiring time and manual dexterity.

U.S. Pat. No. 6,070,380 also issued to Meilleur on Jun. 6, 2000 and entitled "Concrete Wall Formwork Module" discloses a prefabricated concrete formwork module that may be assembled with other similar modules in the manner of a brick wall to form a mould into which concrete is poured. Even though Meilleur's module solves the above-mentioned problem of the assembly, it presents the new drawback that it is cumbersome, takes a lot of space and is therefore costly to transport.

U.S. Pat. No. 8,276,340 issued to Polycrete International Inc. on Oct. 2, 2012 and titled "Concrete Wall Formwork Module" teaches a collapsible formwork module having wall panels that are movable between a retracted parallel relationship and a spaced apart parallel relationship. The panels are reinforced by the inclusion of wire meshes that are hingedly assembled by attaching spacer rods to both panels therebetween. This module solves the space problem while remaining easy to install. However, a drawback of these modules is that they are configured with an inherent horizontal directionality that renders tedious their positioning and assembly vertically. Moreover, their side by side assembly is not locked until adjacent modules are attached.

SUMMARY

The problem of the directionality of a deployable concrete wall formwork module from the prior art is solved by providing both lateral and both longitudinal opposite side edges of the modules with complementary shapes that lock in place two laterally or longitudinally adjacent modules when they are deployed. For example, the opposite side edges of adjacent modules interlock in one direction and are configured for adjoining according to a shiplap arrangement in the other direction.

According to an illustrated embodiment, there is provided a concrete wall formwork module comprising first and second panels that are connected for movement between a fold up parallel relationship and a spaced apart parallel relationship; each of the first and second panels including lateral side edges, each configured for coupling with an opposite lateral side edge of the corresponding first or second panel of an identical module; each of the first and second panels further including longitudinal side edges, each configured for coupling with an opposite longitudinal side edge of the corresponding first or second panel of the identical module.

According to another embodiment, there is provided a formwork for a concrete wall including a plurality of modules as recited above that are interconnected side by side and/or one on top of the other.

According to still another embodiment, there is provided a deployable concrete wall formwork module including lateral side edges, each being configured for interlocking with one of the lateral side edges of an identical module only when both modules are deployed.

Other objects, advantages and features will become more apparent upon reading of the following non-restrictive description of illustrative embodiments thereof, given by way of example only with reference to the accompanying drawings.

DETAILED DESCRIPTION

Figure 1:
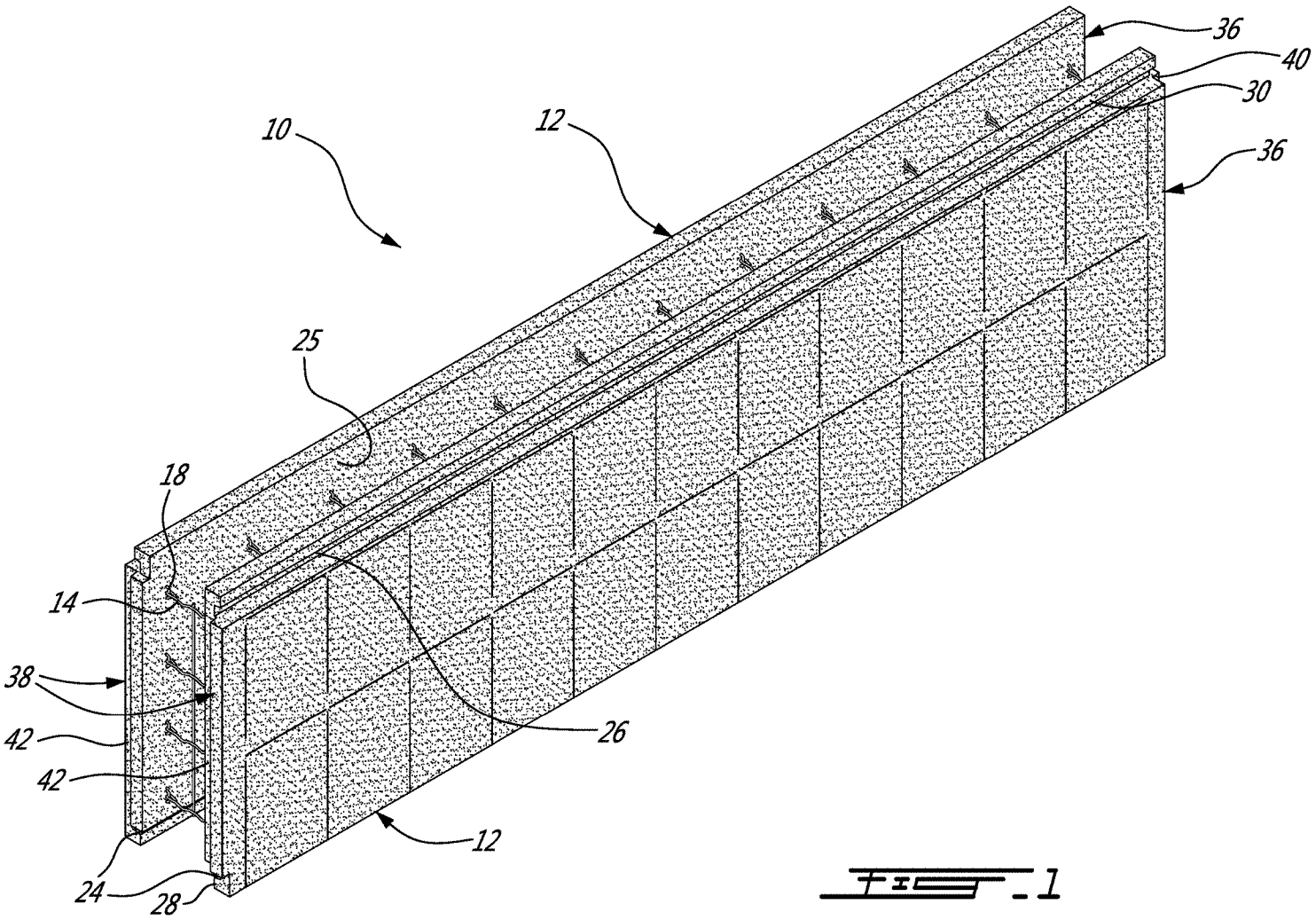
FIG. 1 is a perspective view of a concrete wall formwork module according to a first illustrative embodiment.

In the following description, similar features in the drawings have been given similar reference numerals, and in order not to weigh down the figures, some elements are not referred to in some figures if they were already identified in a precedent figure.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements.

A prefabricated formwork module 10 for casting a concrete wall will now be described with reference to FIGS. 1 to 4.

The module 10 comprises two panels 12 that are attached so as to remain in a parallel relationship via a plurality of connectors 14 of same length.

Each panel 12 includes a plurality of metal strips 16 embedded therein. As will be described hereinbelow in more detail, each strip 16 supports a plurality of aligned lugs 18 along its length. The strips 16 and lugs 18 are configured, sized and positioned within the panels 12 so that the lugs 18 stand out of the panels 12 in a direction towards the other panels 12.

As will be described hereinbelow in more detail, the connectors 14 hingedly interconnect the two panel structures to allow relative movement thereof along the longitudinal direction between a fold up parallel relationship to a spaced apart parallel relationship (both shown in FIG. 4).

The panels 12 are made of plastic foam having a high insulating ability such as polyurethane and expanded or extruded polystyrene. Other materials can also be used including, without limitations, another polymeric material, wood, fiberglass, etc. Moreover, the two panels 12 need not to be made from the same material.

The panels 12 are rectangular shaped, are forced in a parallel relationship by the connectors 14 and are relatively positioned so that one of the two (2) modules is pivoted 180 degrees relative to the other module about an axis perpendicular to both planes defined by the panels 12.

Each panel 12 has two interlockable opposite lateral edges 20 and 22. It results that each lateral edges 20 or 22 of each panel 12 are interlockable with the opposite end 22 or 20 of a similar panel 12 of another concrete wall formwork module 10. The interlocking of the edges 20-22 of two panels 12 yields a side by side alignment of the two adjoined panels 12.

The interlockable edges 20 and 22 are defined by a respective groove 24 and 26, each defining a respective tongue 28 and 30 at the distal end of portions 20 and 22. The pair of interlockable edges 20 defines a female connecting portion 29 and the pair of interlockable edges 22 define a male connecting portion 31

Figure 4:
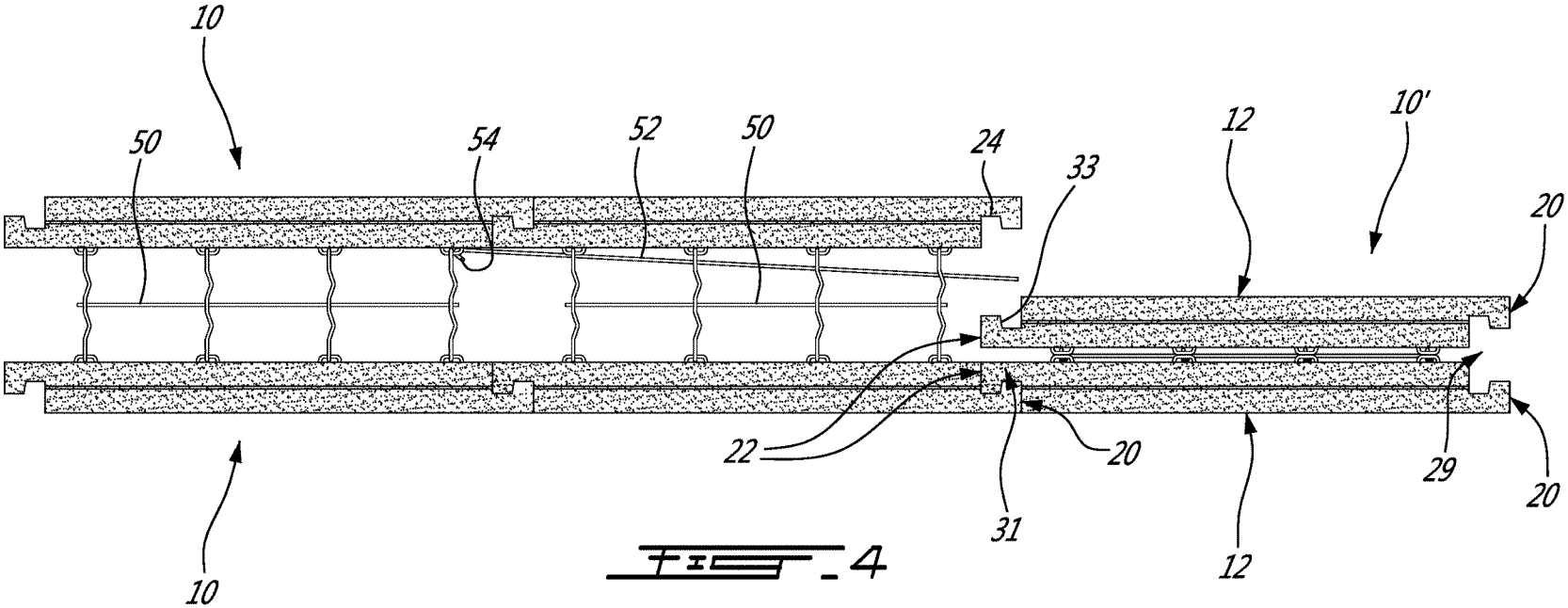
FIG. 4 is a top plan view of three identical modules from FIG. 1, two modules being shown assembled and a third one being partially assembled.

As can be seen for example in FIG. 4, the first and second edges 20 and 22 are configured and sized for interlocking first and second modules 10 in such a manner that the panels 12 of adjoined modules 10 extend continuously within same parallel plans.

Moreover, when one panel 12 of a first module 10 is locked in place in the corresponding panel 12 of an already deployed second module 10 (see for example the right most module 10 in FIG. 4), moving the module 10 from its retracted parallel relationship to its spaced apart parallel relationship causes the interlocking of the second panels 12 of the two concrete wall formwork modules 10.

As can be also seen in FIG. 4, the small wall 33 of the tongues 28 and 30 is slanted so as to facilitate the nesting of the tongues 28 and 30 in the grooves 24 and 30 respectively when two modules 10 are connected.

Illustrated embodiments of a concrete wall formwork module are not limited to the tongue portions 28 being at the very end of the panels 12, which can be at other distances from the end. Also, the tongue and groove portions can have other configurations allowing coupling of two panels.

The transversal edges 36 and 38 of the panels 12 are also configured for complementary engagement. More specifically, the edge portions 36 and 38 are provided with respective grooves 40 and 42 positioned on same side in a shiplap arrangement. Other engagement means, including tongues and grooves can alternatively be provided on the top and bottom edge portions 36 and 38.

While the pair of panels 12 from a module 10 according to the first illustrated embodiment are relatively movable between the fold up parallel relationship to the spaced apart parallel relationship along the longitudinal direction, a module according to another embodiment (not shown) may be configured for relative movement of its panels along the lateral direction.

Modules 10 can be made in different size and/or having different configuration. Also, the configuration and size of the panels 12 in a module 10 are not limited to the illustrated embodiment. The modules 10 can be configured for interlocking on their longitudinal or transversal side edges. In other words, the modules 10 can be configured for interlocking vertically or horizontally.

A plurality of parallel metal strips 16 are embedded in each panel 12. The ensemble of the panel 12 with strips 16 will be referred to as a panel structure.

According to the first embodiment, the adjacent strips 16 are positioned every 8.375 inches (21.27 cm) along the length of the panel 12 and are oriented perpendicularly to the length of the panel 12. According to other embodiments (not shown), the distance between adjacent strips 16 is more or less than 8.375 inches.

Figure 2:
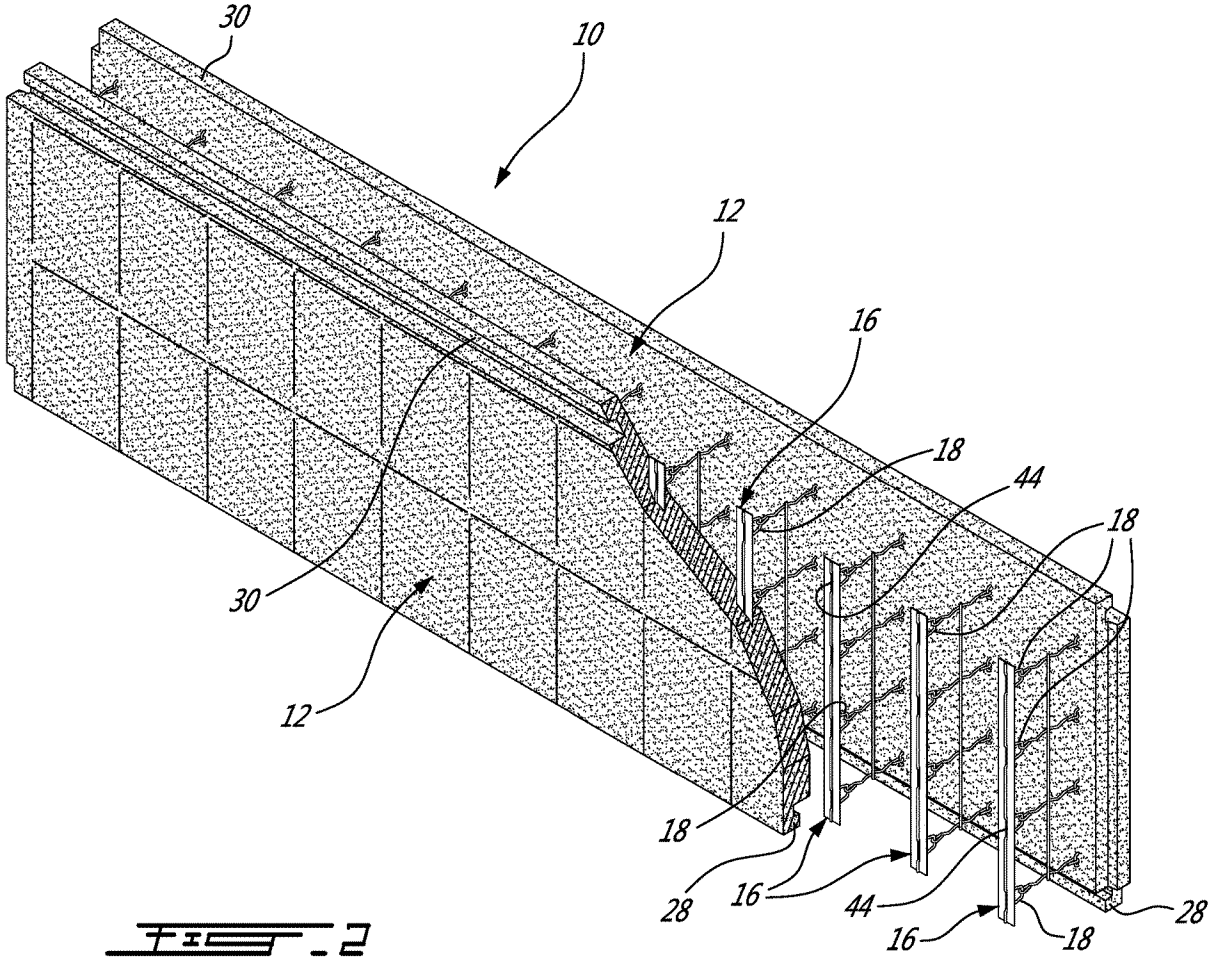
FIG. 2 is a partially cutaway perspective view of the module from FIG. 1.
Figure 3A:
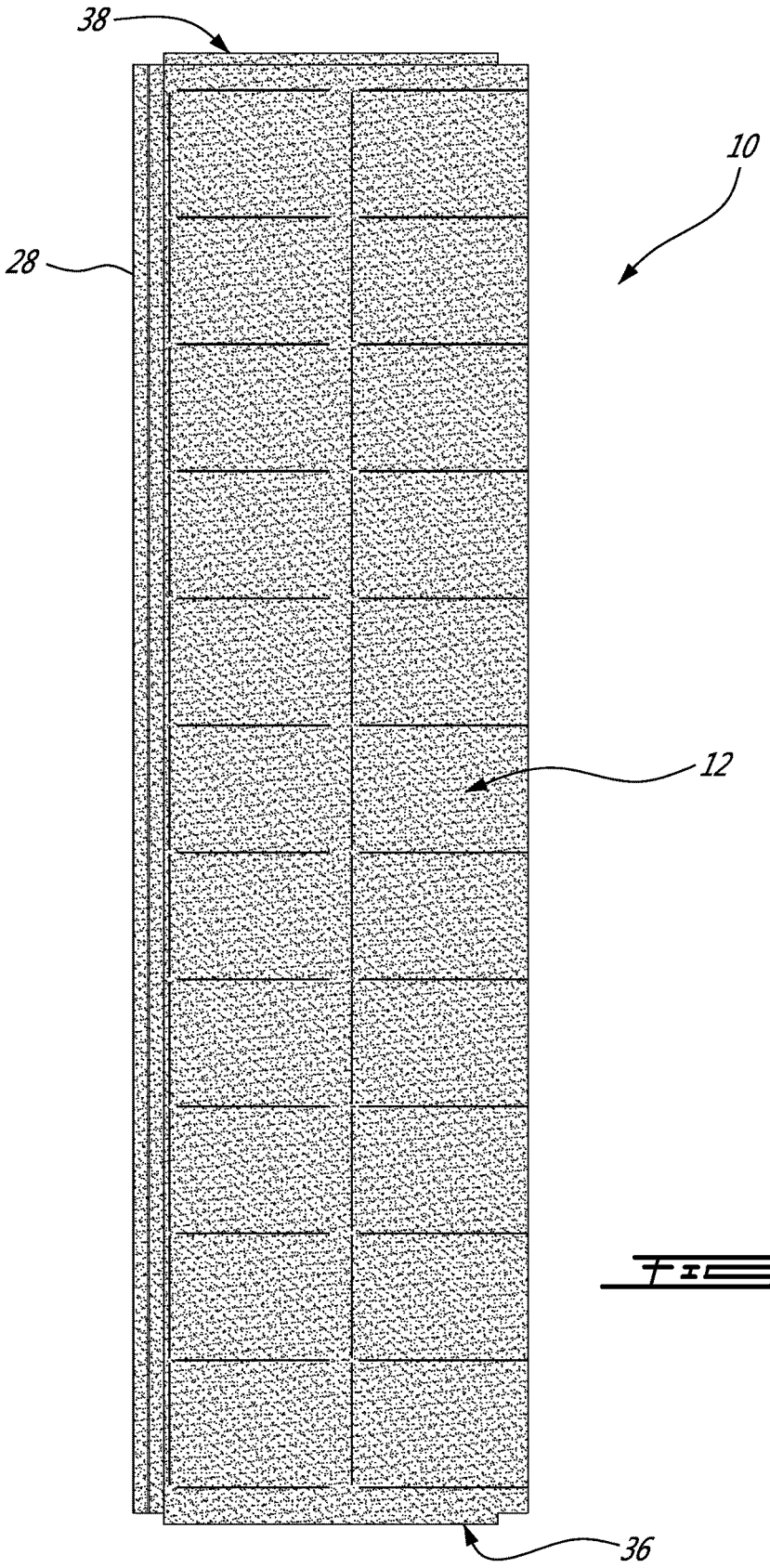
FIGS. 3A-3C are respectively front and side elevation views and a top plan view of the module from FIG. 1.
Figure 3B:
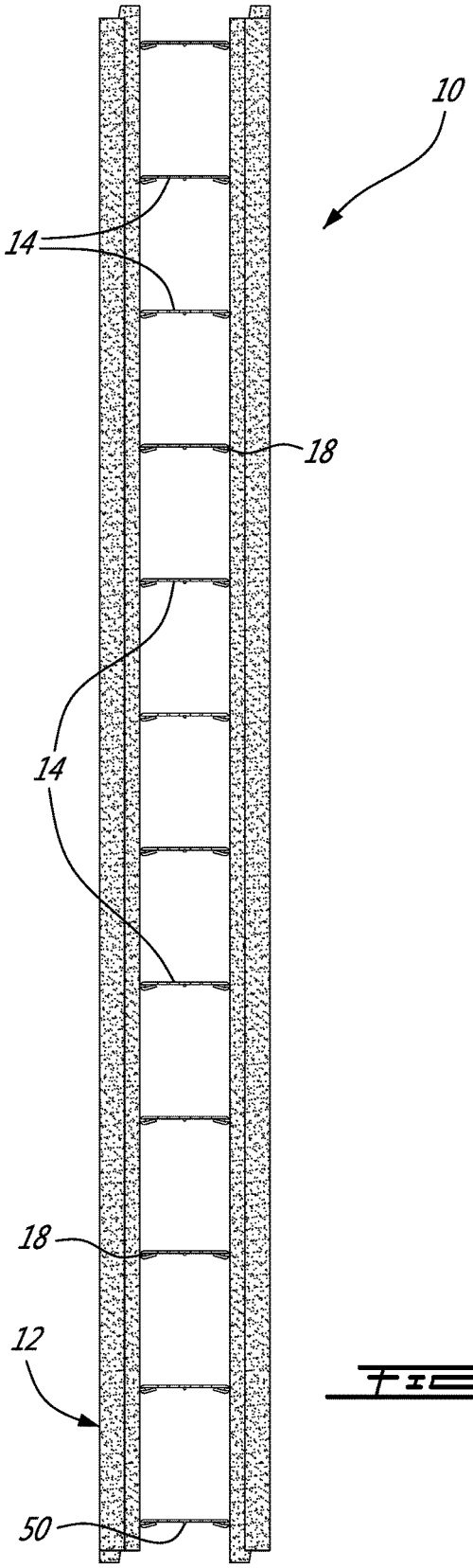
Figure 3C:
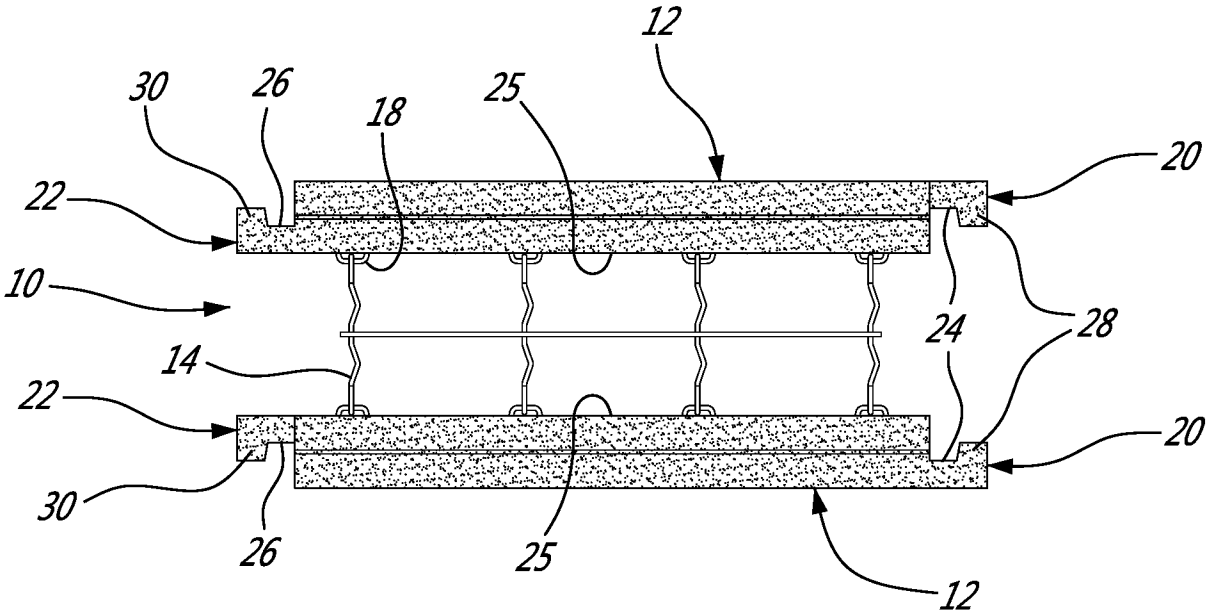

With references to FIG. 2, the strips 16 include a series of longitudinal slits 44 that receive lugs 18 therethrough. According to the illustrated embodiment, the lugs 18 are in the form of C-shaped portion of a one-piece bended metal wire 46 that extends through the slits 44 on a side of the strip 16. The remaining portions of the wire 46 are secured to the strips 16 on the other side thereof.

The pair of panels 12 of a module 10 are attached together and maintained in a parallel relationship via the connectors 14, which are secured to the panels 12 via the lugs 18. More specifically, the connectors 14 are secured to the lugs 18 by closing a loop thereabout. The attachment of the connectors 14 to the lugs 18 is such that the panels 12 are movable between a retracted or collapse or fold up parallel relationship and a spaced apart parallel or opened relationship. The parallel relationship is forced by the rigidity and equal length of the connectors 14 and lugs 18.

The fact that the modules 10 are collapsible is advantageous for their storing and handling, and also for their assembly side-by-side to form a formwork (see for example FIG. 4).

The lugs 18 are not limited to the illustrated shape and can be of any other configuration and size that allow receiving a hook or the like. According to another embodiment (not shown), the lugs 18 are arc-shaped member welded or fastened to the strip 16.

In order to add rigidity and force to the module 10 and/or reinforcement to a concrete wall or structure formed there-with, a rod 50 is secured to connectors 14 (see FIG. 4). The rods 50 are aligned at a same longitudinal position along each module 10.

According to another embodiment, the rod 50 is differently shaped or omitted.

It is to be noted that the module 10 is intended to be manufactured off construction site. Considering that its structural and functional characteristics are retained in both its collapse and opened configurations, it can be easily transported from a manufacturing site to a construction site.

Figure 5A:
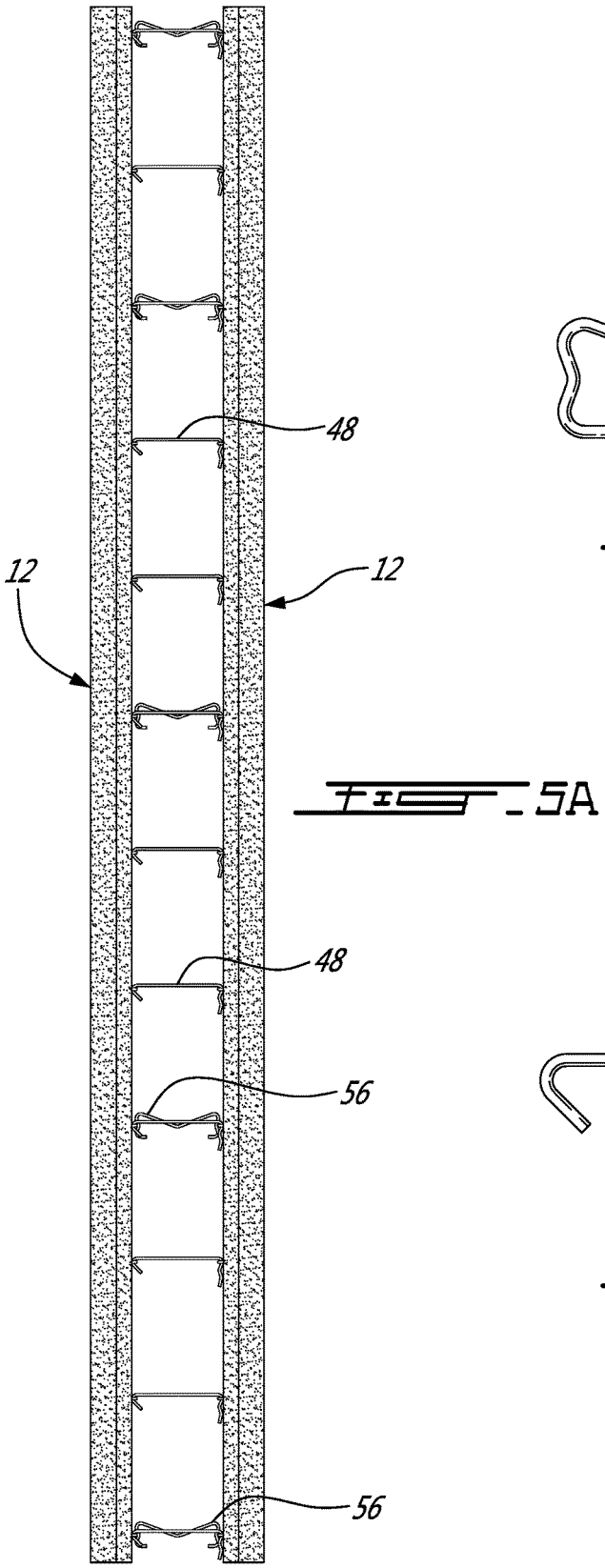
FIG. 5A is a side elevation similar to FIG. 3B illustrating a concrete wall formwork module according to a second illustrated embodiment.
Figure 5B:
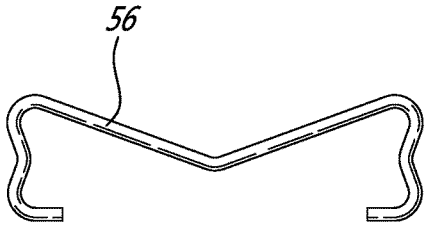
FIGS. 5B-5C are side elevations of respectively a connector and a spacer rod from the module of FIG. 5A.
Figure 5C:
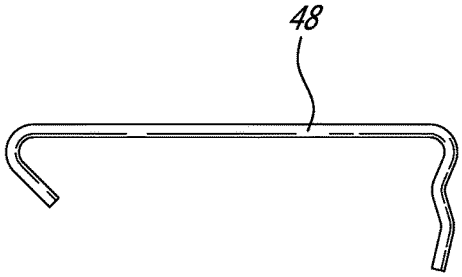

Other characteristics and features of the module 10 will become more apparent upon reading the following description of a use thereof with reference to FIGS. 4-5C.

As already mentioned, it can be advantageous to transport and store the modules in a collapse configuration as shown with the right most module 10 in FIG. 4.

In starting a formwork or any other construction assembly, a first module 10 is rightly positioned and opened. We will refer to such a module as being installed. Since ground preparation and any other preliminary steps are believed to be well known in the art, they will not be described herein in more detail.

A further module 10' is positioned contiguous to one already installed, while this further module 10' is in the collapse or partially collapse position. The connecting end 22 of the male connector portion 31 of the added module 10' is coupled to the connecting end 20 of the female connector portion 29 of the already installed module 10. This arrangement is shown in the two right-most modules in FIG. 4.

The two panels 12 of the module 10' are then moved away from each other while the partial interconnection between the two modules 10-10' is preserved. When the new module 10' is fully opened, the interconnection of the second connecting end 22 of the male connector portion 31 of the module 10' with the second female connector portion 24 of the already installed module 10 is automatic and the two adjacent modules 10-10' are then firmly connected. This procedure is repeated with other modules 10 having the same or different dimensions as required.

A person skilled in the art will appreciate that a new module 10 is secured to adjacent modules in both the lateral and longitudinal direction at the same time by the unique movement of the new module from its fold up to its spaced apart configuration.

A tension rod 52 can be mounted to adjacent modules 10 therebetween to add cohesion to the assembly. For such purpose, the rod 52 is provided with a hook 54 at one end, and the rod 52 is positioned through the connector 14 to better secure the interlocking of the panels 12.

With reference to FIGS. 5A-5B, spacers 56 can also be installed in addition to the connectors 14 to stabilize the open configuration of the module during the completion of the formwork assembly and the pouring of concrete therein. Such spacers 56 can also be used when modules 10 are pre-assembled together before being installed.

FIG. 5A shows a second illustrative embodiment of a concrete wall formwork module wherein, as a difference with the module 10, the connectors 48 are differently configured than the connectors 14.

Figure 7:
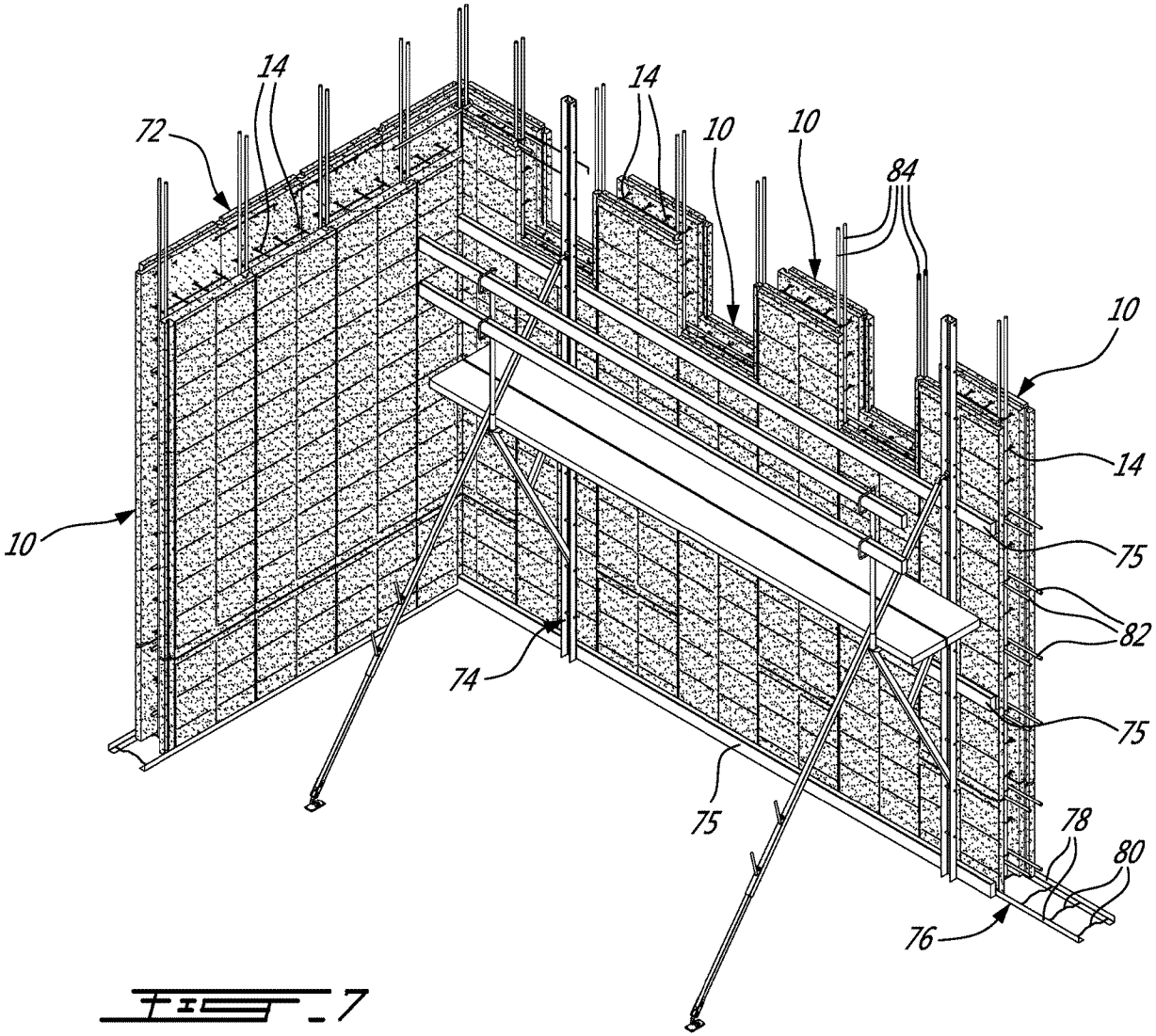
FIG. 7 is a perspective view of an assembly of modules from FIGS. 1 and 6A according to an illustrative embodiment.

As illustrated in FIG. 7, a plurality of modules 10 can be connected side-by-side to form a formwork wall. As mentioned hereinabove, the modules can also be stacked readily taking advantage of the complementarity of the transversal edge sides.

Contrarily to formwork modules from the prior art, the length of the module 10 can be modified easily, for example on the construction site, by cutting the panels 12 between two adjacent strips 16 thereof using for example a hot wire (when the panels 12 are made of polystyrene) or else. This is allowed by the structure of the panels 12 that do not include a reinforcement mesh embedded therein.

Figure 6B:
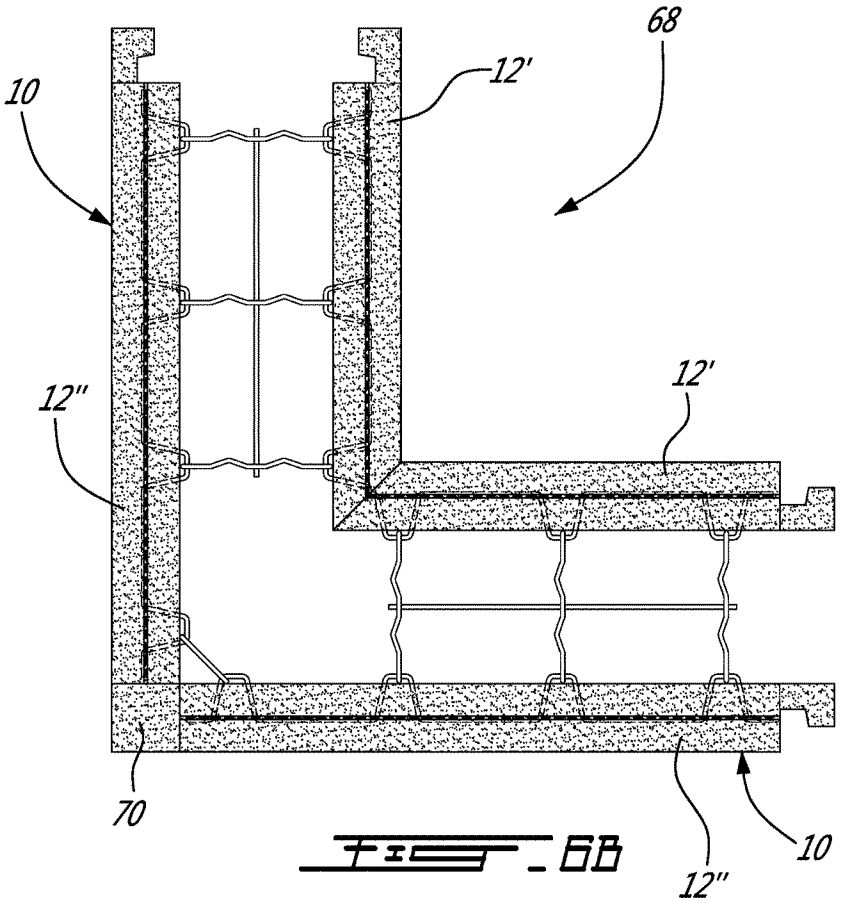
FIGS. 6A and 6B are top plan views of corner assemblies according to further illustrative embodiments.
Figure 6A:
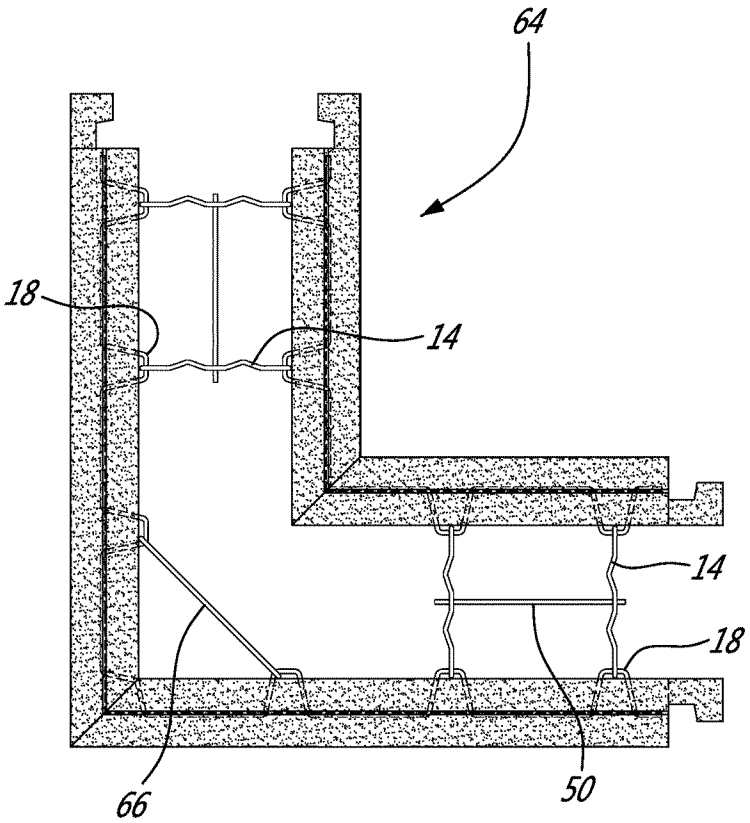

As shown in FIGS. 6A and 6B, corner elements and any other adapted modules can be created on site or before to create a complete operational formwork.

With reference to FIG. 6A, two modules 10 can be cut at a 45 degrees angle and then joined to form a 90 degrees corner assembly 64. The external joint is glued or attached using another well-known means. According to a more specific embodiment, the internal joint is not glued so as to allow pre-assembling the corner assembly 64 prior to installation at the construction site. This allows easing the attachment of a securing rod 66 to both modules 10 via adjacent lugs 18.

According to another illustrating embodiment, a corner assembly 68 is formed using two modules 10, having only their inner panels 12' cut at a 45 degrees angle. A square-shaped element 70, which is made for example of the same insulating material than the panels 12, is secured to both exterior panels 12", using glue or another fastening means, in the outer gap formed thereby. Similarly to the embodiment shown in the previous Figure, the inner joint can be left unattached prior to installation of the assembly 68.

Similarly the modules 10 can be cut at other angles or assembled differently than described hereinabove so as to allow forming a corner assembly at other degree angle than 90 degrees.

The thickness and material used for the strips 16 as well as their number and position within the panels 12 are selected so that the resulting panel 12 and module 10 is able to withstand the thrust force of concrete poured in a formwork assembled using modules 10.

The strips 16 can be made of steel, wood, plywood, a polymeric material, or else, or a combination thereof. The strips 16 can further be used to act as or to mount furring strips.

Returning now to FIG. 7, an assembly 72 of panels 10 to form a wall is shown, wherein a scaffolding assembly 74 is secured to the assembly 72 to help construction workers executing the lineage and pouring concrete (not shown).

To secure the scaffolding assembly 74, beams, such as without limitations a 2"×4" (5.08 cm×10.16 cm) wood beams 75, are secured to the assembly 72. A ground base 76 is also shown in FIG. 7 that helps securing to the ground and levelling the assembly 72. The wood beams 75 can be left in place after the assembly 74 of panels 10 is finished so as to improve the rigidity thereof. The wood beams 75 further act as furring strip. As mentioned hereinabove the furring strips are secured to the modules 10 via the strips 16 embedded in the panels 12.

According to the embodiment illustrated in FIG. 7, the ground base 76 is in the form of two parallel tracks 78 secured and distanced by sleepers 80. The ground base 76 is made of galvanized steel or of (an)other similar material(s).

As mentioned hereinabove, the modules 10 can be cut longitudinally and/or transversally as required by the construction project. For example, the upper portion of the modules 10 in the wall portion from the left has been cut to allow the mounting of a concrete floor assembly (not shown), Also, in some applications, a 2"×10" (5.08 cm×10.40 cm) wood panel (not shown) is used in place of the upper beams 75 to form a wood plate that is provided to support a floor assembly (not shown).

The walls are formed with modules 10 assembled in staggered rows. This arrangement provides good continuity in the wall dimensions from one floor level to the next. The wall assembly 74 is however not limited to such an arrangement of modules 10.

Also, as shown in FIG. 7, reinforcing steel rods 82 and 84 are supported and attached to the connectors 14 and/or lugs 18 using hooks or ties (not shown).

Since scaffolding assembly, lineage and concrete pouring are believed to be well known in the art, they will not be described herein in more detail.

It is to be noted that other modifications could be made to the modules 10 or 60 described hereinabove and illustrated in the appended drawings. For example:

- tie wires, clips, tie-rods or other fasteners can further be used for attaching pairs of stand-out lugs 18 when securing two adjacent modules;
- the panels of the side wall panel structures are not limited to the materials described hereinabove. They can also be made without limitations of counterveneer, plasterboard, particle board, and any insolating plastic material. Any combination is also possible;
- the configuration of the lugs may differ. They can have, for example, a rounded profile. Also, they can be made of independent pieces secured to the strips 16;
- the orientation of the strips 16 relative to the panels 12 may be different than described herein and illustrated in the drawings;
- the strips 16 can be replaced or supplemented by a metal mesh;
- the panel structures are not limited to the generally rectangular form;
- also, the two side wall panels of a single module can have different geometries and be made of different material.

Although a concrete wall formwork panel has been described hereinabove by way of illustrated embodiments thereof, it can be modified. It is therefore to be understood that numerous modifications may be made to the illustrative embodiments and that the scope of the claims should not be limited by the preferred embodiment, but should be given the broadest interpretation consistent with the description as a whole.

What is claimed is:

1. A concrete wall formwork module comprising first and second panels that are connected for movement between a fold up parallel relationship and a spaced apart parallel relationship; each of the first and second panels including lateral side edges, each configured for coupling with an opposite lateral side edge of the corresponding first or second panel of an identical module; each of the first and second panels further including longitudinal side edges, each configured for coupling with an opposite longitudinal side edge of the corresponding first or second panel of the identical module;

for each of the first and second panels, one of i) the lateral side edges and ii) the longitudinal side edges are configured to be coupled according to a shiplap arrangement with the corresponding opposite lateral or longitudinal side edge of the identical module, and the other one of i) the lateral side edges and ii) the longitudinal side edges are configured for tongue and groove coupling;

one of the lateral side edges and longitudinal side edges of the first panel is configured for interlocking with the corresponding opposite side edge of the identical module when a) the same one of the lateral side edges and of the longitudinal side edges of the second panel is coupled with the corresponding opposite side edge of the first identical module; b) the other one of the lateral side edges and longitudinal side edges of the first panel is coupled with the corresponding opposite side edge of a second identical panel, and c) the module is moved from the fold up parallel relationship to the spaced apart parallel relationship;

wherein each panel includes strips embedded therein: each of the strips including lugs secured thereto and extending out of the panel towards the other panel; the first and second panels being connected by connectors hingedly mounted to the lugs; each of the strips includes a series of aligned slits; the lugs being defined by portions of a wire secured to the strips that extends through the slits.

2. The module as recited in claim 1, wherein at least one of the first and second panels includes reinforcement.

3. The module as recited in claim 2, wherein the reinforcement is embedded in the at least one of the first and second panels.

4. The module as recited in claim 2, wherein the reinforcement includes a mesh.

5. The module as recited in claim 1, wherein the strips are made of a material selected from the group consisting of a metal, a polymeric material, wood, and an alloy.

6. The module as recited in claim 1, further comprising at least one reinforcing rod that is secured to a series of the connectors, transversally therefrom.

7. The module as recited in claim 6, wherein the at least one reinforcing rod comprises a plurality of reinforcing rods, each secured to a different series of the connectors; the plurality of reinforcing rods being aligned within a plane transversal to the connectors and parallel to the first and second panels.

8. The module as recited in claim 1, wherein the first and second panels are hingedly connected by at least two of the connectors.

9. The module as recited in claim 8, wherein at least one of the connectors is in the form of a tie wire or of tie-rod.

10. The module as recited in claim 1, wherein at least one of the first and second panels is made of an insulated material.

11. The module as recited in claim 10, wherein the insulated material is selected from the group consisting of polyurethane, expanded or extruded polystyrene, wood, and fibreglass.

12. The module as recited in claim 1, wherein at least one of the first and second panels includes at least one of counterveneer, a plasterboard, and particle board.

13. The module as recited in claim 1, wherein the first and second panels are made of different materials.

14. A formwork for a concrete wall including a plurality of modules as recited in claim 1 that are interconnected side by side and/or one on top of the other.

15. The formwork as recited in claim 14, wherein at least one spacer is secured in each module between the first and second panels so as to maintain the spaced apart parallel relationship.

16. The formwork as recited in claim 14, wherein at least one tension element is secured between two adjacent modules.

17. The formwork as recited in claim 14, further comprising at least one corner element that is made from two of the modules, each having its first panel cut at an angle.

18. The formwork as recited in claim 14, further comprising at least one of horizontal rods and vertical rods attached to the modules therebetween.

19. The formwork as recited in claim 18, wherein the first and second panels are connected by connectors hingedly mounted to the first and second panels therebetween; the at least one horizontal rods and vertical rods being attached to the connectors.

20. The formwork as recited in claim 14, further comprising beams mounted to an exterior face of the formwork.

21. The formwork as recited in claim 14, wherein at least some of the plurality of modules are assembled in staggered rows.

22. The formwork as recited in claim 14, wherein at least some of the plurality of modules are cut so as to be shorter.

23. The module as recited in claim 1, wherein the interlocking of said one of the lateral side edges and longitudinal side edges is such as to prevent movement of the identical module relative to the module in first and second directions both perpendicular to the first and second panels.

* * * * *